United States Patent [19]

Werneke et al.

[11] 4,081,357

[45] Mar. 28, 1978

[54] PROCESS FOR SELECTIVE FLOCCULATION OF HEMATITIC IRON ORES IN THE PRESENCE OF NON-FERROUS MINERALS

[75] Inventors: Michael Francis Werneke, Milford, Conn.; Joseph Van Wyk, Green Bay, Wis.

[73] Assignee: American Cyanamid Company, Stamford, Conn.

[21] Appl. No.: 766,155

[22] Filed: Feb. 7, 1977

[51] Int. Cl.[2] ..... B03D 3/06

[52] U.S. Cl. ..... 209/5; 210/54; 526/303

[58] Field of Search ..... 209/5; 75/2; 210/54 A; 526/303, 240, 312

[56] References Cited

U.S. PATENT DOCUMENTS

| | | | |
|---|---|---|---|
| 3,397,953 | 8/1968 | Galvin et al. | 210/54 A X |
| 3,480,761 | 11/1969 | Kolodny et al. | 210/54 A |
| 3,545,941 | 12/1970 | Wilson | 209/5 |
| 3,658,772 | 4/1972 | Volk et al. | 526/303 X |

*Primary Examiner*—Frank W. Lutter
*Assistant Examiner*—Ralph J. Hill
*Attorney, Agent, or Firm*—William J. van Loo

[57] ABSTRACT

Acrylic acid polymers of specified composition and solution viscosity are selective flocculants for iron values derived from hematitic ores in the presence of non-ferrous minerals.

10 Claims, No Drawings

PROCESS FOR SELECTIVE FLOCCULATION OF HEMATITIC IRON ORES IN THE PRESENCE OF NON-FERROUS MINERALS

This invention relates to a process for the separation of iron ore from siliceous minerals. More particularly, this invention relates to such a process wherein a polyacrylic acid is employed as a selective flocculant for hematitic ores from the non-ferrous siliceous mineral matter occurring therein.

Major ores used as the sources of metallic iron include magnetite, taconite, and hematite. At the present time, approximately 4 million tons of hematite is processed per yer. With dwindling reserves of high grade magnetitic and taconitic ores, it is expected that greatly increased amounts of hematite will be recovered in the immediate future.

The present process for recovering hematite from the siliceous non-ferrous mineral matter with which it occurs utilizes causticized corn starch as selective flocculant, the pH generally being in the range of 10.5 – 11.5. High dosages of starch are required to obtain effective recovery of iron values. Since corn starch has food value, increased use thereof in mineral applications will tend to reduce available food sources. Waste waters from processing involving corn starch increase biodegradable oxygen demands, thereby contributing to pollution problems. The high pH values required for processing with causticized corn starch necessitates the use of large quantities of caustic, which increases costs and creates difficulties in treating waste waters.

Accordingly, there exists the need for a process for recovering hematite from its gangue, which process overcomes deficiencies of the conventional process and reduces consumption of products having food value. Such a provision would refill a long-felt need and result in a significant advance in the art.

In accordance with the present invention, there is provided a process for recovering iron values from a hematitic iron ore and its gangue material which comprises: slurrying a fine ground hematite ore in water at a concentration of about 5% to 20% by weight; treating said slurry with an effective amount of an acrylic acid polymer containing at least about 70 mole percent of acrylic acid units in free acid or alkali metal slurry form and any balance of one or ore mer units compatible therewith, said polymer having a viscosity as a 0.5 weight percent solution in water at pH 5.2 and 25° C. in the range of about 100 to 5,000 centipoises; settling the iron values as an underflow concentrate; and recovering the iron concentrate.

The process of the present invention frees corn starch for nutritional uses, does not require high pH values for effective use and, thus, reduces caustic requirments associated with corn starch, does not increase but may reduce BOD of the waste waters, requires about 1/20 to 1/25 of the amount of treating agent compared to starch usage while still providing equal or superior recovery of iron values, and simplifies processing. These results are quite surprising and highly unexpected in view of the vast chemical differences between starch and acrylc acid polymer and the high degree of selectivity exhibited by the acrylic acid polymers.

The process of the present invention is specifically directed to the separation of hematitic iron ore from siliceous materials. The process is particularly effective with hematitic ores derived from the Tilden mine in Michigan but ores from other sources are also useful.

In carrying out the process of the present invention the hematitic ore is slurried as a fine grind, particle size generally below about 350 mesh, in were to provide a concentration of about 5 to about 20 weight percent based on the total weight of slurry. Slurries of lower than about 5 weight percent are generally less dilute than necessary to be effectively processed while slurries greater than about 20 weight percent are generally too thick to process efficiently.

After the slurry has been prepared as specified, it is next treated with an effective amount of a poly(acrylic acid) of specific composition and molecular weight, as defined hereinbelow. The poly(acrylic acid) useful in the process must contain at least about 70 mole percent of acrylic acid units and any balance of mer units compatible with said acrylic acid units form the useful polymers. By "compatible with" is meant that such mer units do not interfere with the effectiveness of the acylic acid units in the beneficiation of hematitic ores. The acrylic acid units in the poly(acrylic acid) may be present in free acid form or may be present in the form of alkali metal or ammonium ($NH_4^+$) salts.

The useful polymers may be homopolymers of acrylic acid or copolymers containing at least about 70 mole percent of acrylic acid units and any balance of one or more mer units. Useful mer units include those derived from acrylamide, acrylonitrile, methacrylic acid, and the like. The polymer may be obtained by suitable polymerization processes using the proper monomers and following conventional procedures. The polymer may also be prepared by hydrolysis of polymers of compositions that yield the desired hydrolysis products under suitable conditions. Hydrolyzable polymers include those of acrylamide, acrylonitrile, and the like.

The useful polymers of the present invention are also characterized by a specified range of solution viscosities when measured under particular conditions. The polymers will have a viscosity in the range of about 100 to 5,000 centipoises as a 0.5 weight percent solution in water when measured at 25° C. and a pH of 5.2. The viscosity is that measured by a Brookfield viscometer using a No. 3 spindle and a speed of 60 revolutions per minute. However, it is not necessary to use the viscometer specified to make viscosity measurements since correlations between various viscometers exist. Preferred viscosities are generally from about 250 to 1,000 under the conditions of measurement specified.

By "treating the slurry" with the acrylic acid polymer is meant that the specified amount of polymer is added to the slurry and mixed vigorously for about 30 seconds to ensure thorough mixing of the polymer throughout the slurry. By "an effective amount" of the acrylic acid polymer is meant an amount that is effective in recovering hematite from its accompanying gangue material. The particular amount that is effective will vary widely depending upon the particular ore being processed, the polymer composition employed, and the like. Thus, it is not possible to state the precise amount of polymer that will be effective in any given instance, but such amount can readily be determined following the principles given herein. Generally, the effective amount will range from about 0.001 to about 0.1 pounds per ton of dry solids in the slurry being processed. In preferred instances, amounts of about 0.005 to about 0.025 pounds per ton, same basis, are used.

After the slurry has been treated with polymer, as specified, the iron values are settled as an underflow concentrate while the gangue material remains suspended in the supernatant liquid. Generally, effective settling will occur in about 10 minutes after the polymer treatment has been effected, but the particular time of settling is not critical and will vary widely depending upon the ore processed, the polymer composition, the polymer viscosity, the use level of polymer, and the like. Settling is carried out until no apparent increase in volume of underflow concentrate is observed. Extended times of steeling are not necessary since, as indicated, effective settling occurs rapidly.

Once effective settling has been obtained, the iron concentrate is recovered. This operation can be performed by any convenient procedure, using conventional equipment associated with such procedures. The supernatant liquid may be decanted to enable easy recovery of the iron concentrate, and permit disposal of the gangue in the decantate.

The invention is more fully illustrated by the examples which follow wherein all parts and percentages are by weight unless otherwise specified.

EXAMPLE 1

A finely ground hematite iron ore 80% below 400 mesh) in the amount of 122 grams (solids basis) was slurried in sufficient water to provide 1 liter of slurry and sufficient caustic was added to provide a pH of 11.1. The slurry was treated with a given dose of flocculant, mixed vigorously for 30 seconds, and allowed to settle for 10 minutes. The top 900 milliliter portion of the slurry was then decanted and designated as the slime (waste) portion, while the remaining 100 milliliter portion was recovered as the iron-containing underflow (product). The flocculants employed and analysis for solids and iron contents are given in Table I, which follows,

TABLE I

| Beneficiation Of Hematite Ore (12.2% Slurry) | | | | | | | |
|---|---|---|---|---|---|---|---|
| | Viscosity | Dosage | Slimes | | Underflow | | Recovery |
| Flocculant | cps[1] | Lbs./ton | Gms. | % Fe | Gms. | % Fe | % Fe |
| Starch | — | 0.205 | 43.28 | 28.4 | 78.46 | 0.0 | 71.9 |
| 95:5 AA:AM[2] | 400 | 0.008 | 35.58 | 28.8 | 86.09 | 38.8 | 76.5 |
| 95:5 AA:AM | 940 | 0.008 | 31.02 | 28.4 | 90.69 | 39.0 | 80.1 |
| 95:5 AA:AM | 800 | 0.008 | 30.96 | 27.8 | 90.76 | 38.8 | 80.4 |

Notes:
[1]At 0.5% in water at 25° C. and pH = 5.2, using Brockfeld viscometer, No. 3 spindle at 60 RPM.
[2]Note ratio of repeating AA = acrylic acid, AM = acrylamide units, acid in form of sodium salt to the extent governed by slurry pH.

The results given in Table I show that higher levels of iron recovery are obtained with flocculants of the present invention at approximately 1/25 of the conventional dosage of causticized starch.

EXAMPLE 2

Example 1 was repeated in all essential details except that the slurry contained only 85 grams of the iron ore of Example 1 and the dosage levels of flocculants were varied from those of Example 1. Dosage levels and analyses for solids and iron contents are given in Table II, which follows.

TABLE II

| Beneficiation of Hematite Ore (8.5% Solids) | | | | | | | |
|---|---|---|---|---|---|---|---|
| | Viscosity | Dosage | Slimes | | Underflow | | Recovery |
| Flocculant | Cps[2] | Lbs./ton | Gms. | % Fe | Gms. | % Fe | % Fe |
| Starch | — | 0.588 | 22.29 | 23.0 | 61.94 | 39.5 | 82.7 |
| 95:5 AA:AM[2] | 400 | 0.024 | 17.48 | 27.0 | 67.45 | 37.5 | 84.3 |
| 95:5 AA:AM | 940 | 0.007 | 19.74 | 28.0 | 65.20 | 37.8 | 81.7 |
| 95:5 AA:AM | 800 | 0.019 | 16.15 | 25.9 | 67.89 | 37.4 | 85.9 |

Notes:
[1]At 0.5% in water at 25° C. and pH = 5.2, using Brockfeld viscometer, No. 3 spindle 60 RPM.
[2]Note ratio of repeating AA = acrylic acid, AM = acrylamide units, acid in form of sodium salt to the extent governed by slurry pH.

The results given in Table II illustrate the low dosage levels required for flocculants of the present invention compared to that of the conventional dosage of causticized starch while still achieving substantially equivalent iron recovery.

EXAMPLE 3

The procedure of Example 1 was again followed in all essential details except that the slurry contained only 95 grams of the iron ore of Example 1. A single flocculant of the present invention was employed at constant dosage level, 0.017 lbs./ton and the pH of the slurry was varied in spearate runs. The slurry pH and analyses for solids and iron contents are given in Table III, which follows.

TABLE III

| Beneficiation of Hematite Ore (9.5% Solids) | | | | | | | |
|---|---|---|---|---|---|---|---|
| | Viscosity | Slurry | Slimes | | Underflow | | Recovery |
| Flocculant | Cps[1] | pH | Gms. | % Fe | Gms. | % Fe | % Fe |
| 95:5 AA:AM[2] | 800 | 11.1 | 22.20 | 24.4 | 72.45 | 39.5 | 84.1 |
| 95:5 AA:AM | 800 | 10.1 | 27.80 | 26.5 | 66.35 | 40.2 | 78.3 |
| 95:5 AA:AM | 800 | 9.1 | 20.58 | 23.0 | 73.88 | 39.7 | 86.1 |

TABLE III-continued

| Beneficiation of Hematite Ore (9.5% Solids) | | | | | | | |
|---|---|---|---|---|---|---|---|
| | Viscosity | Slurry | Slimes | | Underflow | | Recovery |
| Flocculant | Cps[1] | pH | Gms. | % Fe | Gms. | % Fe | % Fe |
| 95:5 AA:AM | 800 | 8.1 | 14.90 | 20.8 | 79.99 | 38.7 | 90.9 |

Notes:
[1]At 0.5% in water at 25° C. and pH = 5.2, using Brockfeld viscometer, No. 3 spindle at .60 RPM.
[2]Note ratio of repeating AA = acrylic acid, AM = acrylamide units, acid in form of sodium salt to the extent governed by slurry pH.

The results given in Table III indicate that pH is not critical in the process of the present invention and, accordingly, that caustic requirements of the conventional process can be effectively reduced by use of flocculants of the present invention.

We claim:

1. A process for recovering iron values from a hematitic iron ore and its gauge material which comprises: slurrying a fine ground hematite ore in water at a concentration of about 5% to 20% by weight; treating said slurry with an effective amount of an acrylic acid polymer containing at least about 70 mole percent of acrylic acid units in free acid or alkali metal or ammonium ($NH_4^+$) salt forms and any balance of one or more mer units compatible therewith, said polymer having a viscosity as a 0.5 weight percent solution in water at pH 5.2 and 25° C. in the range of about 100 to 5,000 centipoises; settling the iron values as a underflow concentrate; and recovering the iron concentrate.

2. The process of claim 1 wherein the viscosity of said acrylic acid polymer is in the range of about 250 to 1,000 centipoises.

3. The process of claim 1 wherein the amount of acrylic acid polymer employed is from about 0.001 to 0.1 pounds per ton of dry solids in said slurry.

4. The process of claim 1 wherein the amount of acrylic acid polymer employed is from about 0.005 to about 0.025 pounds per ton of dry solids in said slurry.

5. The process of claim 1 wherein the acrylic acid polymer is a copolymer of 95 mole percent acrylic acid and 5 mole percent acrylamide.

6. The process of claim 5 wherein said acrylic acid polymer has a viscosity of 400 centipoises.

7. The process of claim 5 wherein said acrylic acid polymer has a viscosity of 800 centipoises.

8. The process of claim 5 wherein said acrylic acid polymer has a viscosity of 940 centipoises.

9. The process of claim 1 further including decanting the supernatant above said underflow concentrate prior to recovering said iron concentrate.

10. The process of claim 9 wherein said acrylic acid polymer is a copolymer of 95 mole percent acrylic acid and 5 mole percent acrylamide.

* * * * *